United States Patent [19]

Hix et al.

[11] 4,354,851

[45] Oct. 19, 1982

[54] METHOD FOR MAKING A DECORATED, WATER-RESISTANT, RIGID PANEL AND THE PRODUCT MADE THEREBY: TRANSFER DYE PROCESS ONTO RIGID PANEL

[75] Inventors: Daniel H. Hix, Pittsburg, Kans.; Daniel D. Closser, Port Washington, Wis.

[73] Assignee: United States Gypsum Company, Chicago, Ill.

[21] Appl. No.: 769,753

[22] Filed: Feb. 17, 1977

[51] Int. Cl.[3] ..... D06P 1/76

[52] U.S. Cl. ..... 8/471; 8/506; 428/914

[58] Field of Search ..... 8/2.5, 2.5 A, 4, 471; 428/914

[56] References Cited

U.S. PATENT DOCUMENTS

| | | | |
|---|---|---|---|
| 3,280,735 | 10/1966 | Clark | 96/48 HD |
| 3,363,557 | 1/1968 | Blake | 8/2.5 A |
| 3,707,346 | 12/1972 | Markert et al. | 8/2.5 A |
| 3,751,282 | 8/1973 | Massa | 427/205 |
| 3,792,968 | 2/1974 | Rickenbacher | 8/215 |
| 3,829,286 | 8/1974 | Anzai et al. | 8/2.5 |
| 3,860,388 | 1/1975 | Haish | 8/2.5 A |
| 3,952,131 | 4/1976 | Sideman | 8/2.5 A |
| 3,973,058 | 8/1976 | Grover et al. | 8/4 |

FOREIGN PATENT DOCUMENTS

| | | | |
|---|---|---|---|
| 1412963 | 11/1975 | United Kingdom | 8/2.5 A |

OTHER PUBLICATIONS

Webster's New World Dictionary, Second College Edition, (World Publishing Co.) 1972, p. 17.

*Primary Examiner*—A. Lionel Clingman

*Attorney, Agent, or Firm*—Robert M. Didrick; Samuel Kurlandsky; Robert M. Robinson

[57] ABSTRACT

A method for making a decorated, water-resistant, rigid panel comprising supplying a cured, pre-coated rigid panel having a clear, water-resistant polymeric coating on one surface of the panel and a printed sheet having a design, picture or other form of decoration on one surface thereof, said decoration being formed by a sublimable coloring agent. The rigid panel and the printed sheet are originally maintained at room or ambient temperature. The coated surface of the rigid panel and the decorated surface of the printed sheet are brought into physical contact, and their surfaces are maintained in contact for a brief period of time by applying light pressure thereto. While the surfaces are maintained in contact, heat is applied thereto for a short period of time to sublime the coloring agent and cause it to be transferred to and penetrate into the polymeric coating on the surface of the rigid panel. The heat is removed from the surfaces, and the printed sheet is separated from the rigid panel whose polymeric coated surface contains the same decoration as appeared on the printed sheet. The product of this invention comprises a decorated, water-resistant, rigid panel having a clear polymeric coating on one surface, which coating is impregnated by a sublimable coloring agent. The coated surface of the panel comprises at least one clear polymeric top coat and may have additional substrate coatings or layers of polymeric or other materials. It is preferred that the coated surface of the decorated panel have a light stability of at least about 40 hours as measured by the Standard Carbon-Arc Fadometer test (ASTM G25-70), Continuous Exposure to Light, Test Method A.

9 Claims, 3 Drawing Figures

METHOD FOR MAKING A DECORATED, WATER-RESISTANT, RIGID PANEL AND THE PRODUCT MADE THEREBY: TRANSFER DYE PROCESS ONTO RIGID PANEL

BACKGROUND OF THE INVENTION

1. Field of the Invention

A current manufacturing process for decorating wallboard panels such as hardboard or particle board applies conventional printing methods, e.g. gravure or silk screen, to decorate a panel substrate with the selected design, and thereafter, a water-resistant, polymeric coating is applied over the decorated substrate. Generally, there are a limited number of colored substrates to which a large variety of designs or decorations are applied. A massive inventory of colored panel substrates, fully decorated panels and decorating inks or dyes are required at each manufacturing and/or warehousing facility.

For example, if a small amount of product having a particular design is ordered, a minimum economic production run may require that 1000 panels be produced to justify the set up costs. The panels produced in excess of the amount required to fill the order must be inventoried, and in some cases it takes many months to sell the "excess" production. In addition, the introduction of a new line of decorated panels requires substantial inventories. Slow moving products often back-up, and panel designs which are being phased out are often difficult to move. The wallboard panel industry needs a low cost manufacturing process which will eliminate product ovrruns and substantially reduce the inventory levels. 2. Description of the Prior Art The decoration of textile fabrics with sublimable inks or dyes has undergone rapid development during the past ten years. The process is commonly referred to as heat transfer printing wherein a decoration or design is printed on a paper transfer sheet with a subliming dye or ink, and thereafter, the paper is pressed against the textile fabric and heated for a brief period of time whereby the ink is vaporized and transferred to the textile fabric. The dye penetrates into the fabric, forming the design or decoration which was printed on the transfer sheet. This process of heat transfer printing is particularly applicable to knitted polyester fabrics which are very receptive to many subliming dyes. U.S. Pat. No. 3,363,557 illustrates a process for the heat transfer of coloring agents from a transfer sheet to a fabric or other material such as wood, paper, other cellulosic materials, plastic surfaces and even metallic surfaces. This patent does not disclose using the heat transfer printing process to decorate a water-resistant, rigid panel having a clear polymeric coating on one surface.

More recently, U.S. Pat. No. 3,860,388 discloses a method for heat transfer printing with a sublimable dye through a polyolefin release layer to decorate a nonporous thermoplastic sheet or material coated with or bonded to a thermoplastic dye receptor. The method of this patent employs a polyolefin sheet between the dye transfer sheet containing dispersed dyes and the dye receptor thermoplastic material to prevent the printed transfer sheet (paper) from sticking to the thermoplastic dye receptor material. The temperatures employed to sublime or heat transfer the dye are generally sufficient to soften the polyolefin sheet, but it does not stick to the thermoplastic dye receptor material. The method can be used to obtain either high clarity dye transfer, or dye transfer and concurrently lamination of the thermoplastic dye receptor material to a substrate such as hardboard or fiberboard. It appears that in all cases employing a hardboard or fiberboard laminate base material, the dye receptor surface was laminated to the hardboard concurrently with the dye transfer process, and a cured, pre-coated rigid panel was not decorated.

U.S. Pat. No. 3,922,445 discloses a heat transfer printing sheet which can be used to transfer print a variety of base materials. Included in the listed base materials are films and sheets or various synthetic resins, hardboard and gypsum board. There is no disclosure in this patent that a cured, pre-coated rigid panel having a clear, water-resistant polymeric coating can be heat transfer printed.

U.S. Pat. No. 3,952,131, issued on Apr. 20, 1976, discloses a heat transfer print sheet having a polyolefin coating overlying the printed surface to prevent the heat transfer print sheet from adhering to a substrate to which the printing is transferred. The method includes consolidating a plurality of layers of material with heat and pressure, and concurrently therewith, a sublimable dye is transferred from the print sheet to a substrate material. FIG. 3 discloses a finished laminate comprising a polyester film printed with a sublimable dye and laminated to a metalized layer, phenolic impregnated kraft paper and hardboard. There is no disclosure that a cured, precoated rigid panel can be heat transfer printed without requiring a polyolefin layer adjacent to the heat transfer print sheet to prevent adherence to the printed substrate.

There was a series of articles in the American Dyestuff Reporter, February 1975, pp. 23–35, 41, 43–50 and 52–56 disclosing the development of heat transfer printing in the textile fabric industry. Many sublimable dyes are disclosed in these articles and their effectiveness in printing various types of fabric. There is no disclosure that heat transfer printing can be used to decorate a cured, pre-coated rigid panel having a clear, water-resistant polymeric coating on one surface.

SUMMARY OF THE INVENTION

It is an object of this invention to provide a method for making a decorated, water-resistant, rigid panel which solves the problem of maintaining large inventories of decorated panels. Another object is to provide a method for decorating a cured, precoated hardboard panel by heat transferring a sublimable ink decoration from a print sheet to the pre-coated hardboard panel. A further object of the invention is to provide a decorated, water-resistant, rigid panel having a clear polymeric coating on one surface which is impregnated by a sublimable coloring agent, and the decorated surface has a light stability of at least about 40 hours as measured by the Standard Carbon-Arc Fadometer test (ASTM G25-70), Continous Exposure to Light, Method A. A still further object is to provide a decorated, water-resistant wallboard panel for use in shower stalls, kitchens and similar applications in which water-resistance and the decorative surface are important factors in customer acceptance.

It has been discovered that a decorated, water-resistant, rigid panel can be manufactured by bringing a cured, pre-coated rigid panel into contact with a printed sheet having a decoration formed by a sublimable coloring agent and transferring the coloring agent into the coating on the rigid panel by means of heat and pressure. In this manner, the decorated, water-resistant panel is made from a cured, pre-coated rigid panel at the time and in the quantities required by the purchaser or user. The rigid panel forming the substrate base may be a cellulosic formed board such as hardboard, particle board, softboard, insulation board, or it may be a coated gypsum panel or a coated plywood panel.

One of the important factors in practicing the method of this invention is the polymeric coating applied to the surface of the rigid panel and cured by heat, ultra-violet radiation or other curing means, prior to contacting the panel surface with the printed transfer sheet containing the sublimable coloring agent. The polymeric coating provides both water-resistance and a receptor surface for retaining the coloring agent. It is preferred that the surface coating be a clear, polymeric coating selected from alkyd-melamine resins, polyester resins, alkyd resins and acrylic polymers. Any water-resistant, clear polymeric coating material generally used to render hard cellulosic panels water-resistant can be used in this invention, provided that the cured polymer is permeable to the subliming coloring agent and will function as a receptor surface for said coloring agent. It is preferred that the clear polymeric coating comprise a layer having a thickness of at least about 1 mil.

In addition to the water resistant, clear polymeric top coating, the rigid panel may also have one or more substrate coatings. These substrate coatings may also comprise polymeric coatings, however, they may contain pigments, coloring agents or other fillers, whereas it is essential that the top coat be clear so as not to interfere with the permeability and deposition of the sublimable coloring agent.

The sublimable coloring agents (ink or dye) used in this invention are well known in the textile decorating art and do not constitute a critical feature. The coloring agents may comprise a resin binder and a dyestuff which is generally referred to as a disperse dye. It is generally preferred that the disperse dye be an organic dyestuff such as disazo dyes, anthraquinone dyes and methine dyestuffs. The sublimable coloring agent is printed on a transfer sheet of paper or other material, which may contain a special release coating, and it must be capable of being heat transferred into the clear polymeric coating at the sublimation temperature of the dye. Generally, the sublimable coloring agent should be capable of being heat transferred or sublimed at temperatures ranging from about 150° C. to about 220° C.

In general, the method of this invention comprises supplying a cured, pre-coated rigid panel having a clear, water-resistant polymeric coating on one surface of the panel and a printed sheet having a design, picture or other form of decoration on one surface, said decoration being formed by a sublimable coloring agent. The rigid panel and the printed sheet are originally maintained at room or ambient temperature. The coated surface of the rigid panel and the decorated surface of the printed sheet are brought into physical contact, and their surfaces are maintained in contact for a brief period of time by applying light pressure to the surfaces. In general, pressures ranging from about 1 to about 10 psi are sufficient to maintain intimate contact between the surfaces, however, greater pressures up to 50 psi may be used. The sublimable coloring agent is rapidly transferred from the printed sheet into the clear polymeric coating on the rigid panel, and the heat and pressure are applied to the surfaces for only a short period of time, ranging from about 10 seconds to about 3 minutes. In most cases, the heat transfer process can be completed in less than one minute.

One of the features of this invention is the use of a rigid panel having a cured, clear polymeric coating which functions as the receptor surface for the sublimable coloring agent. Since the coating is cured to a hard, thermoset polymeric material, the problem of the printed sheet sticking to the rigid panel is obviated, particularly when the method is carried out using low pressure and a rapid (30 seconds or less) heat transfer. It is preferred that the pre-coated rigid panel have at least one substrate coating under the cured, clear polymeric top (surface) coat. The substrate coating may comprise a resin binder and a pigment or other coloring agent to provide a uniform background color for the sublimable coloring agent decoration. Additional substrate coatings may be used to improve the adhesion of the background color coat or the clear polymeric top coat to the rigid panel material.

The decorated, water-resistant, rigid panels made in accordance with this invention have many uses. The panels may be used as walls for decorated bathtub or shower enclosures wherein wall panels comprise three sides of the enclosure and must be water resistant. These panels also provide a highly decorative surface which enhances the beauty and appearance of the facility. The panels may be used as a splashboard in and around kitchen sinks and counters which require a water-resistant material to prevent stains caused by splashed water and other liquids. Other potential applications for the decorated, water-resistant panels are in places which must have resistance to water or other liquid soilants and those places in which a washable or readily cleaned surface is desired. In addition, the decorative feature of the panels may be emphasized such as a material to be used in making furniture, particularly children's furniture, wall decoration and graphic displays. The reduced costs in manufacturing decorated, water-resistant panels provided by this invention extends the commercial availability of such panels to applications not generally considered to be markets for such materials.

The above and other objects and advantages of this invention will be more fully described in the description of the preferred embodiment, particularly when read in conjunction with the accompanying drawings which form a part of this specification.

DESCRIPTION OF PREFERRED EMBODIMENT

The method of this invention comprises making a decorated, water-resistant, rigid panel by employing a heat transfer process and a sublimable coloring agent to decorate a cured, pre-coated rigid panel having a clear, water-resistant polymeric coating on one surface of the panel. It is essential that the panel coating be completely cured to a hard, thermoset-like material prior to decorating it by the heat transfer process in order to prevent the sheet printed with the sublimable coloring agent from sticking to the rigid panel after contact therewith under heat and pressure. Another important factor is that the top (surface) coating on the rigid panel must be clear and a good receptor for the sublimable ink, for it has been found that the use of pigments or coloring matter in the top coating interferes with the receptivity of the coating for the sublimable coloring agent.

The heat transfer process can be carried out quickly, efficiently and cleanly. Light pressure ranging from about 1 to 50 psi is used to maintain physical contact between the pre-coated rigid panel and the printed sheet carrying the decoration or print. The heat transfer process is generally carried out at temperatures ranging from about 150° C. to about 220° C. and the heat and pressure are applied to the panel and printed sheet surfaces for a very short period of time, ranging from about 10 seconds to about 3 minutes. After removing the pressure and the heat source, the printed sheet is readily removed from the panel surface, and the printed sheet may be reused if it retains sufficient sublimable coloring agent for decorating additional panels.

Figure 1:
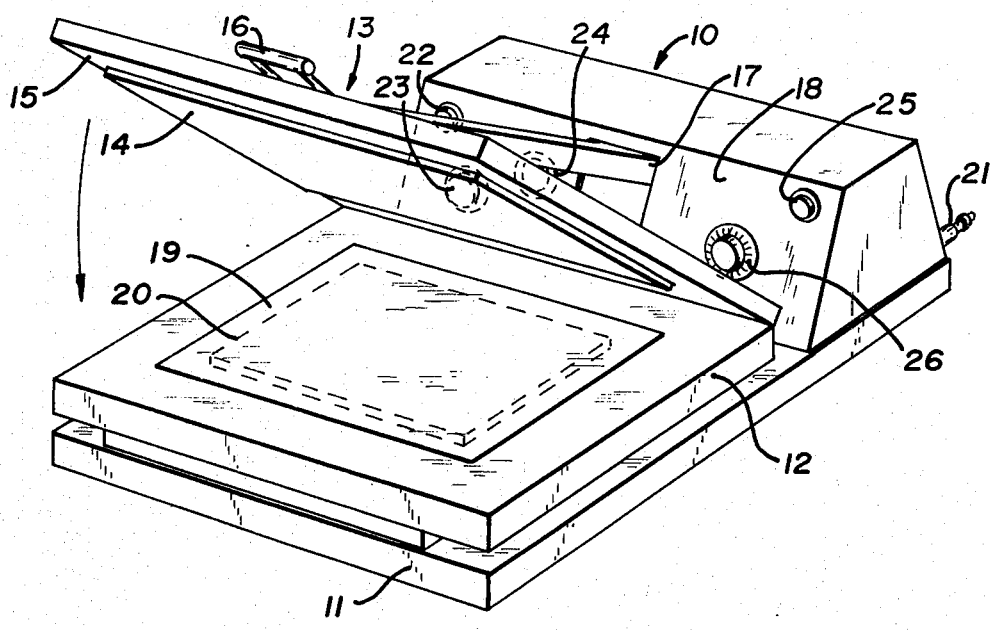
FIG. 1 is a schematic drawing of a heat transfer press for making individual decorated, water-resistant, rigid panels in accordance with this invention.

Referring now to the drawings, FIG. 1 illustrates a heat transfer press (10) for making individual decorated, water-resistant, rigid panels in accordance with this invention. The heat transfer press (10) comprises a base member (11) covered with a resilient silicone rubber plate (12) which serves as a support member for the rigid panel which is to be decorated. Located above the base member (11) and silicone plate (12), there is a moveable member (13) comprising an adjustable hot platten (14) attached to a fiberglass insulated heat shield (15) to which there is attached an activator handle (16). There is an attachment means (17) which connects the member (13) to a control panel (18) portion of the heat transfer press (10) in such a manner that the moveable member (13) can be brought into contact with the silicone plate (12). The attachment means (17) also functions as a duct for the electrical resistance element used to heat the hot platten (14) and also for an air pressure line used to provide the pressure exerted by the moveable member (13) in compressing the printed sheet (19) against the rigid panel (20). The air is supplied to the heat transfer press through the air receptacle (21). The control panel (18) contains the instruments for controlling the pressure and the duration of the process including an ON/OFF indicator lamp (22), an air pressure control knob (23), an air pressure gauge (24), a heat element ON/OFF indicator lamp (25) and an automatic reset timer (26). A heat control knob and a thermometer showing the temperature of the hot platten (14) are not illustrated, but they are located on the top surface of the heat shield (15).

Figure 2:
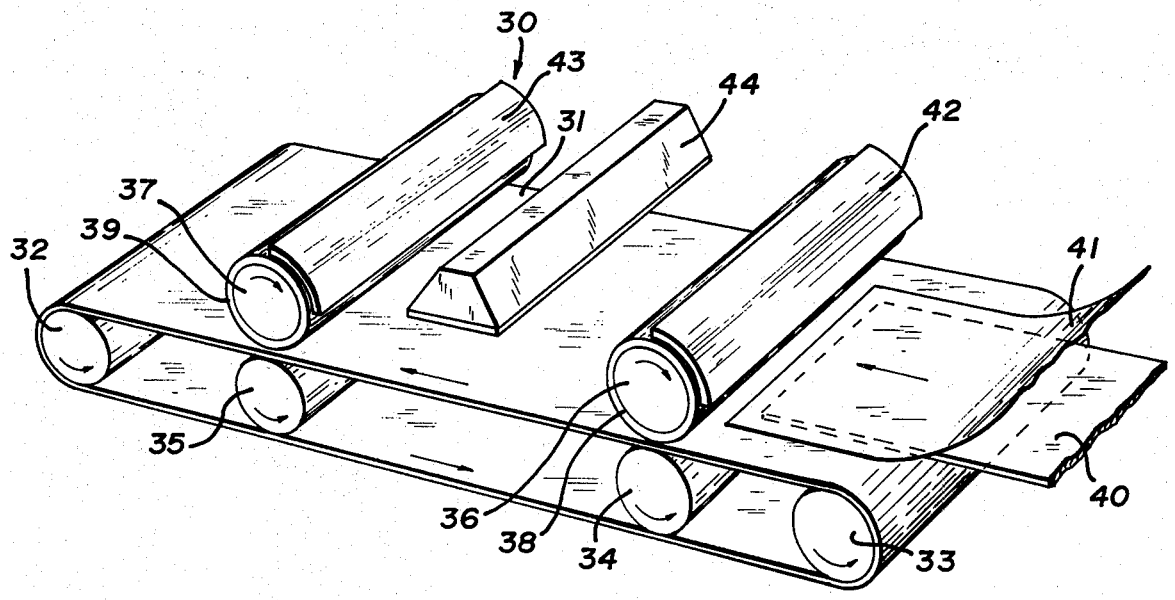
FIG. 2 is a schematic drawing of a heat transfer printing press for continuously making decorated, water-resistant, rigid panels in accordance with this invention.

The heat transfer press illustrated in FIG. 1 is limited to decorating one rigid panel in each batch, which may be feasible for producing small quantities of decorated panels. However, for the mass production of large quantities of decorated panels, a continuous process is required. Apparatus for practicing the method of this invention in a continuous process is illustrated in FIG. 2.

A heat transfer printing press (30) for carrying out a continuous process comprises a rubber conveyor belt (31) which may be coated with polytetrafluorethylene to enable the belt to withstand the elevated temperatures used in the heat transfer process. The belt (31) may have a variable width and length, depending upon the size of the rigid panel to be decorated. The conveyor belt (31) is driven at adjustable speeds by two motor driven, hard rubber rollers (32) and (33) which may be placed about 4 feet apart, with two intermediate, non-driven, hard rubber rollers (34) and (35) placed opposite rollers (36) and (37) to compress the rigid panel (40) and printing paper (41). Each of these rollers may be about 8 inches in diameter. The two pneumatically operated rollers (36) and (37), each having a silicone rubber coating (38) and (39) respectively, are placed about 2.5 feet apart and are located directly above rollers (34) and (35). The rigid panel (40) is fed to the belt (31) with the transfer printing paper (41) containing the sublimable coloring agent fed from a roller to the surface of the rigid panel (40). The rollers (36) and (37) are capable of being lowered into contact with the conveyor belt (31) whereby the rigid panel (40) and printing paper (41) are compressed as they pass between the rollers (34) and (36) and rollers (35) and (37) by a pressure up to about 50 psi. Radiant heaters (42) and (43) are adjacent to the silicone rubber coated rollers (36) and (37) and are used to heat these rollers to temperatures ranging from about 150° C. to about 220° C. Hot roller (36) is lowered pnuematically to apply heat and pressure to the printing paper (41) and the rigid panel (40). As the paper and panel pass through the first set of rollers, another radiant heater (44) provides heat to the paper and panel whereby the sublimation of the coloring agent continues as the paper and panel advance to the second set of rollers. The heat and pressure applied by hot roller (36) causes the transfer paper (41) to adhere to the rigid panel (40) as it comes out of the first set of rollers (34) and (36), whereby the panel (40) and the paper (41) remain in physical contact until the sublimation and printing process is completed. The duration of the heat transfer process is controlled by the speed of the conveyor belt (31). Of course the length of the conveyor belt (31) and the number of sets of rollers are matters of operator's choice and depend upon the size of the rigid panels.

Figure 3:
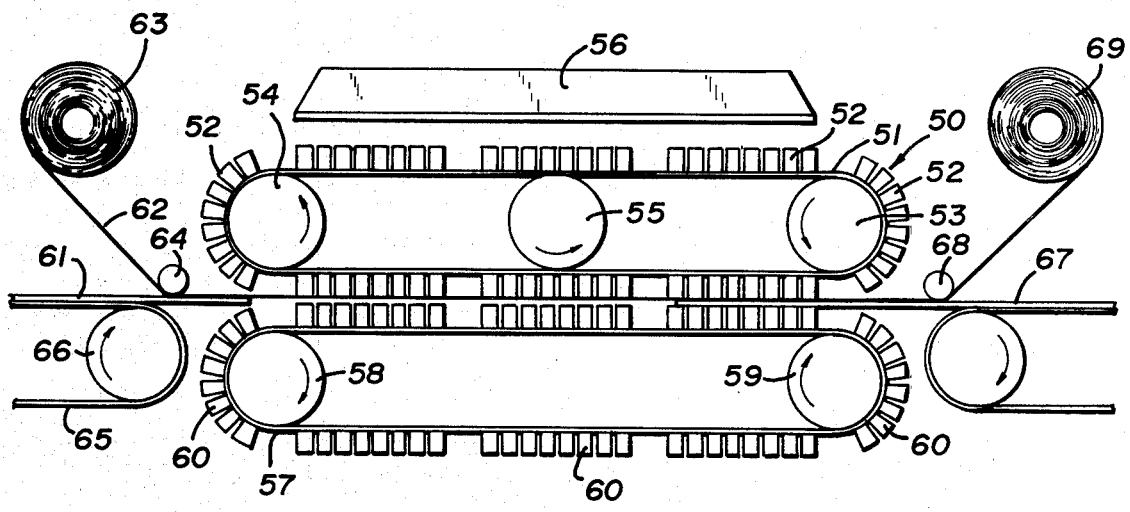
FIG. 3 is a schematic drawing of an alternative heat transfer printing press for continuously making decorated, water-resistant, rigid panels in accordance with this invention.

Referring now to FIG. 3, alternative apparatus for practicing the method of this invention in a continuous process is illustrated. The apparatus (50) generally comprises a conveyor system wherein a series of plattens are arranged to provide for the application of heat and pressure to transfer printing paper in physical contact with a rigid panel which is to be decorated. The panel may be 4 feet by 8 feet in size, and therefore, the apparatus is quite large.

One conveyor velt (51) carries several hot plattens (52) which are sectionalized to permit them to travel readily around the motor driven support rollers (53) and (54). The hot plattens (52) function as a heat sink and must have sufficient mass to carry heat from one end of the conveyor to the other. It is preferred that the plattens (52) be made of aluminum, but the load carried by the conveyor belt (51) is still very heavy, and an additional non-driven roller (55) may be required to support the load carried by the belt (51). A radiant heat source (56), such as infra-red lamps, may be used to heat the plattens (52).

Another conveyor belt (57) is supported by motor driven support rollers (58) and (59) which are synchronized with rollers (53) and (54). Trays (60), which are also sectionalized to permit them to travel around the rollers (58) and (59), are adapted to receive and support the rigid panel (61) which is to be decorated. The trays (60) may be made from a plastic material or a light metal such as aluminum. It may also be necessary to have one or more additional support rollers for the conveyor belt (57) and also the conveyor belt (51). Either the plattens (52) or the trays (60), or both, should have a resilient coating, e.g. silicone rubber, to accomodate surface irregularities in the rigid panel and to permit compression of the panel and the transfer printing paper (62) without tearing or otherwise damaging the paper.

A roll (63) of the transfer printing paper is supplied, and the paper (62) passes around the roller (64) and into contact with the panel (61) as it is placed on a tray (60). A conveyor belt (65) and roller (66) system may be used to support the rigid panel before it is placed on the tray (60). The transfer printing paper (62) passes between the hot plattens (52) and the panels supported on the trays (60) and is compressed against the panel while the heat transer process is being carried out. The plattens (52) are aligned with the trays (60) and both are firmly fastened to the conveyor belts (51) and (57) respectively. After the heat transfer printing process is completed, the decorated panel (67) is discharged from the tray (60), and the transfer printing paper (62) passes over roller (68) and onto a take-up roll (69).

One of the objects of this invention is to provide a decorated, waer-resistant, rigid panel having a clear polymeric coating on one surface which has a light stability of at least about 40 hours as measured by the Standard Carbon-Arc Fadometer test (ASTM G25-70), Continuous Exposure to Light, Method A. This test procedure is fully described in the Annual Book of ASTM Standards, Part 41, pages 789–793. It has been found that the method of this invention does consistently provide a decorated, water-resistant, rigid panel having a light fastness rating of at least 40 hours, and in many cases, the panels have a light fastness rating of more than 100 hours.

The following working examples illustrate the method for making a decorated, water-resistant, rigid panel in accordance with this invention:

EXAMPLE 1

In carrying out this example, a heat transfer press (Hix N-600 commercially available from Hix Automation, Inc.) similar to the press illustrated in FIG. 1 was used to decorate a cured, pre-coated hardboard panel. The hardboard panel had a solid white ground coat containing an alkyd resin binder, and it had a clear top coat consisting of an alkyd-melamine resin. The top coat had a thickness of about 1.5 mils. A printed transfer paper containing a sublimable blue dye (Celliton BLue G - Colour Index 64500) in a decorative design was used to supply the sublimable coloring agent.

The pre-coated hardboard panel was placed in the heat transfer press and the printed side of the transfer paper was placed against the alkyd-melamine resin coated surface of the panel. The press was closed and a polytetrafluoroethylene coated hot platten, heated to a temperature of about 160° C., was brought into contact with the printed transfer paper and pressed it against the hardboard panel. A pressure of about 40 psi was used to compress the paper and the panel. The heat and pressure were applied for about 60 seconds during which time the blue dye was sublimed, transferred from the printing paper and penetrated the clear top coat on the hardboard panel. The transfer paper was stripped from the panel, and the blue dye decoration in the clear top coat provided a decorated, water-resistant, hardboard panel.

EXAMPLE 2

Several sublimable coloring agents were evaluated for their ability to decorate hardboard panels. Coloring agents from different suppliers were tested in carrying out the method of this invention. In some cases, the sublimable coloring agents were supplied as prints on heat transfer paper, and in others, the ink or dye was supplied and it was printed on paper by either silk screening or a gravure method. All of the hardboard panels were cured and pre-coated with a solid white ground coat containing an alkyd resin binder and a clear top coat consisting of an alkyd-melamine resin. The top coat had a thickness of about 1 mil.

As in Example 1, all of the hardboard panels were decorated using a heat transfer press similar to the press illustrated in FIG. 1 to apply heat and pressure to the transfer paper and hardboard panel. The hot platten was heated to a temperature of about 205° c. A transfer pressure of 40 psi was used to compress the transfer paper against the hardboard panel.

Following the manufacture of the decorated, water-resistant, hardboard panels using a variety of subliming inks, each decorated hardboard panel was tested for its light stability in accordance with the Standard Carbon-Arc Fadometer test (ASTM G-25-70) using Method A-Continuous Exposure to Light. The following results were recorded:

| Source | Ink Color/ Identification | Light Stability Rating | Decoration Quality |
|---|---|---|---|
| No. 1 | Red | 22 hrs. | Fair |
| " | Black | " | " |
| " | Blue | " | " |
| " | Green | " | " |
| " | Yellow-I | 66 hrs. | " |
| " | Yellow-II | 100 hrs. | " |

For Source No. 1, the inks which were supplied were thick and had to be diluted by conventional ink extenders prior to being gravure printed on the transfer paper. The hardboard decoration was not sharp in appearance.

| Source | Ink Color/ Identification | Light Stability Rating | Decoration Quality |
|---|---|---|---|
| No. 2 | Red 75 E 2071 | 60 hrs. | Good |
| " | Yellow 75 E 2070 | 60 hrs. | " |
| " | Red 75 E 2119 | 40 hrs. | " |
| " | Blue 75 E 2072 | 60 hrs. | " |
| " | Black 75 E 2546 | 40 hrs. | " |

For Source No. 2, the heat transfer paper was supplied already printed with the sublimable ink. It was determined that the paper did not stick to the hardboard panel after the heat transfer was completed. The decorated hardboard had a good appearance.

| Source | Ink Color/ Identification | Light Stability Rating | Decoration Quality |
|---|---|---|---|
| No. 3 | Yellow 6100-32 | 150 hrs. | Good |
| " | Red 6100-34 | " | " |
| " | Blue 6100-36 | " | " |
| " | Black 6100-70 | " | " |

Source No. 3 supplied disperse dyes which were silk screened onto the heat transfer paper. A very sharp print and high dye strength were achieved with the silk screen method. The decorated hardboard had a good appearance and outstanding light stability.

| Source | Ink Color/ Identification | Light Stability Rating | Decoration Quality |
|---|---|---|---|
| No. 4 | Orange | 60 hrs. | Good |
| No. 4 | Green | 40 hrs. | " |
| " | Blue | 40 hrs. | " |

Source No. 4 supplied a printed heat transfer paper. The decorated hardboard had a sharp image, and the heat transfer peper did not stick to the coated hardboard.

| Source | Ink Color/ Identification | Light Stability Rating | Decoration Quality |
|---|---|---|---|
| No. 5 | Kanoe (Maroon 13683) | 40 hrs. | Good |
| " | Dizzy Daisy (Blue, White, Red, Green 13753) | 40 hrs. | " |
| " | Roman Check (Blue 13726) | 40 hrs. | " |
| " | Five Stripe (Blue, Black, Yellow 13686) | 100 hrs. | " |
| " | David's Chevron (Blue, Black, Red 13601) | 130 hrs. | " |

Source No. 5 supplied a printed heat transfer paper, each with a fanciful decoration. The paper with David's Chevron print got stuck to the hardboard panel. The panels decorated with Five Stripe and David's Chevron had outstanding light stability. The decorated panels had a good appearance.

| Source | Ink Color/ Identification | Light Stability Rating | Decoration Quality |
|---|---|---|---|
| No. 6 | 142-1 | — | Poor |
| " | 142-2 | — | " |
| " | 142-3 | 20 hrs. | " |
| " | 142-4 | 40 hrs. | " |
| " | 142-5 | 20 hrs. | " |
| " | 142-6 | 100 hrs. | " |
| " | 142-7 | 44 hrs. | " |
| " | 142-8 | 60 hrs. | " |
| " | 142-9 | — | " |

Source No. 6 supplied a printed heat transfer paper. Almost all of the inks stayed on the surface of the panel top coat. It was determined that these printed heat transfer sheets could not be used in practicing the method of this invention.

| Source | Ink Color/ Identification | Light Stability Rating | Decoration Quality |
|---|---|---|---|
| No. 7 | Yellow P-343 NT | 100 | Good |
| " | Yellow P-345 NT | 100 | " |
| " | Orange P-368 | 22 | " |
| " | Brilliant Red P-314 NT | 22 | " |
| " | Scarlet P-355 | 22 | " |
| " | Violet P-344 NT | 22 | " |
| " | Blue P-304 NT | 22 | " |
| " | Blue P-305 NT | 22 | " |
| " | Black XB-6 | 100 | " |
| " | Black XB-8 | 100 | " |

Source No. 7 supplied a printed heat transfer paper. Most of the decorated hardboard panels had a good appearance, and those decorated with the yellow and black inks had outstanding light stability.

Having completely described my invention, I claim:

1. A method for making a decorated, water-resistant, rigid panel which is a cured, pre-coated rigid panel having a clear, water-resistant, polymeric top coating on one surface of the panel and at least one substrate polymeric coating under the clear, polymeric top coating with the substrate coating adjacent to the clear top coating containing a colored pigment and a polymeric binder which comprises (1) bringing said cured, pre-coated rigid panel into contact with a printed transfer sheet having a decoration formed by a sublimable coloring agent, (2) placing the side of the transfer sheet containing the coloring agent in direct contact with the clear top coating on the panel, (3) applying light pressure ranging from about 1 to about 50 psi to the transfer sheet and rigid panel to mantain intimate contact between their surfaces, (4) applying heat to the surfaces of the transfer sheet and rigid panel for a short period of time ranging from about 10 seconds to about 3 minutes whereby the temperature at the transfer sheet surface ranges from about 150° C. to about 220° C. which causes the coloring agent to sublime and penetrate into the polymeric top coating on the panel, (5) removing the heat and pressure from the transfer sheet and rigid panel surfaces, and (6) recovering a decorated, water resistant, rigid panel after readily stripping the transfer sheet from the coated surface of the rigid panel.

2. A method in accordance with claim 1 in which the clear, polymeric top coating has a thickness of at least about 1 mil, and the polymer is selected from alkyd-melamine resins, polyester resins, alkyd resins and acrylic polymers.

3. A method in accordance with claim 1 in which there are two substrate coatings beneath the clear, polymeric top coating comprising a filler coat containing a polymeric binder, pigment and other fillers to provide a smooth, even finish and a ground coat containing a polymeric binder and a pigment to hide the color of the board and provide a uniform background color.

4. A method in accordance with claim 1 in which the heat is applied to the surfaces of the transfer sheet and rigid panel for a period of time ranging from about 10 seconds to about 60 seconds.

5. A method in accordance with claim 1 in which the top coat polymer is an alkyd-melamine resin.

6. A method in accordance with claim 5 in which the polymeric binder in the substrate adjacent to the top coat is an alkyd resin which contains a white pigment.

7. A method in accordance with claim 3 in which the polymeric binder in both the filler coat and the ground coat is selected from the group consisting of alkyd-melamine resins, polyester resins, alkyd resins and acrylic polymers.

8. A method in accordance with claim 3 in which the filler coat comprises an acrylic emulsion containing clay, calcium carbonate and titanium dioxide, the ground coat comprises an alkyd-melamine resin containing titanium dioxide and the top coat is a clear, cross-linked, alkyd-melamine resin.

9. A sublimation transfer dyeing process in which sublimable dyestuffs are transferred from an auxilliary carrier web transfer sheet to a non-textile rigid panel support stratum comprising the steps of:

(1) Laminating together as said support stratum,
  (a) a binder layer comprising a polymeric binder and containing a pigment applied to a rigid substrate, and
  (b) on said binder layer a substantially pigment-free transparent layer of hydrophobic synthetic polymer receptive to sublimable dyestuffs;
(2) Curing to form a heat-resistant laminate; and
(3) Transferring said sublimable dyestuffs to said transparent layer by heat-induced sublimation from said auxilliary carrier web transfer sheet.

* * * * *